US011516588B2

(12) United States Patent
Wang et al.

(10) Patent No.: US 11,516,588 B2
(45) Date of Patent: Nov. 29, 2022

(54) SOUND PRODUCTION DEVICE AND PORTABLE TERMINAL

(71) Applicant: Goertek Inc., Shandong (CN)

(72) Inventors: Xinglong Wang, Shandong (CN); Lianshan Ge, Shandong (CN); Chunfa Liu, Shandong (CN)

(73) Assignee: Goertek Inc., Weifang (CN)

( * ) Notice: Subject to any disclaimer, the term of this patent is extended or adjusted under 35 U.S.C. 154(b) by 16 days.

(21) Appl. No.: 17/256,279

(22) PCT Filed: Dec. 29, 2018

(86) PCT No.: PCT/CN2018/125759
§ 371 (c)(1),
(2) Date: Dec. 28, 2020

(87) PCT Pub. No.: WO2020/000987
PCT Pub. Date: Jan. 2, 2020

(65) Prior Publication Data

US 2021/0266671 A1 Aug. 26, 2021

(30) Foreign Application Priority Data

Jun. 25, 2018 (CN) ..... 201810667263.6

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01)

(58) Field of Classification Search
CPC ..... H04R 2209/021; H04R 2209/024; H04R 9/025; H04R 9/06; H04R 2499/11; H04R 9/02; H04R 9/026; H04R 1/02
(Continued)

(56) References Cited

U.S. PATENT DOCUMENTS 7,162,050 B2 * 1/2007 Furuya ..... H04R 9/063 381/345
10,057,685 B2 * 8/2018 Mao ..... H04R 31/006
(Continued)

FOREIGN PATENT DOCUMENTS

CN 104735595 A 6/2015
CN 205283807 U 6/2016
(Continued)

*Primary Examiner* — Disler Paul
(74) *Attorney, Agent, or Firm* — Baker Botts, LLP

(57) ABSTRACT

Disclosed in the present invention are a sound generation device and a portable terminal. The sound generation device comprises a vibration system and a magnetic circuit system, the vibration system and the magnetic circuit system being mounted and fixed to an housing. The housing comprises a first shell and a second shell that are connected and fixed together, the vibration system comprises a first diaphragm and the magnetic circuit system comprises a magnetic yoke, and wherein the first diaphragm is mounted on one surface of the first shell far away from the second shell, and the magnetic yoke and the second shell are injection molded as an integrated part. In the sound generation device of the present invention a conventional plastic housing is split into two shells, by fixing the magnetic yoke to the second shell by injection molding so that the magnetic yoke and the second shell become an independent part which is integrally arranged, it can reduce the assembling process of the Magnetic yoke and the housing, improve the assembling efficiency and connecting strength of the sound generation device, and can provide a bigger space for the magnetic circuit system and improve the product performance.

20 Claims, 14 Drawing Sheets

(58) Field of Classification Search
USPC ..... 381/117, 412, 396
See application file for complete search history.

(56) References Cited

U.S. PATENT DOCUMENTS

| | | | | |
|---|---|---|---|---|
| 10,091,570 | B2 * | 10/2018 | Xiao | H02K 41/0356 |
| 10,694,293 | B2 * | 6/2020 | Huang | H04R 1/2834 |
| 11,290,794 | B2 * | 3/2022 | Shen | H04R 1/02 |
| 2006/0188126 | A1 * | 8/2006 | Andersen | H04M 1/03 381/396 |
| 2017/0180901 | A1 * | 6/2017 | Sun | H04R 31/006 |
| 2018/0167739 | A1 * | 6/2018 | Gu | H04R 9/06 |

FOREIGN PATENT DOCUMENTS

| | | | |
|---|---|---|---|
| CN | 108513230 | A | 9/2018 |
| JP | 2007173880 | A | 7/2007 |

* cited by examiner

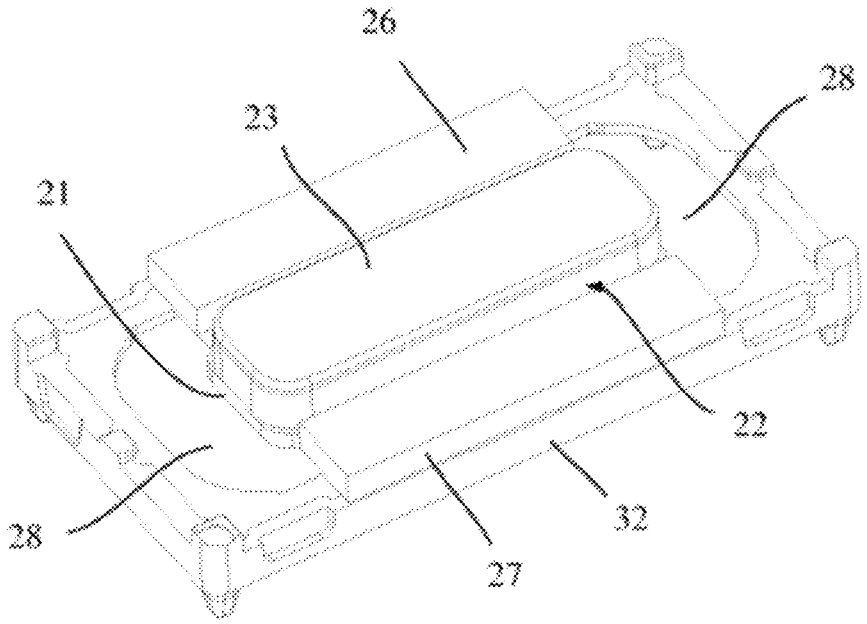
Fig. 11
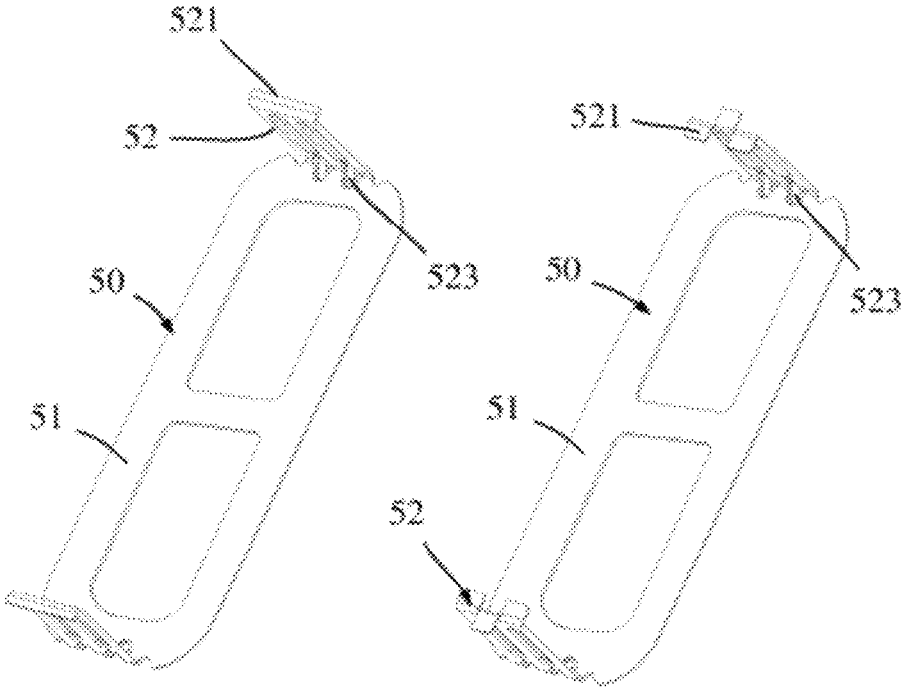
Fig. 12a
Fig. 12b
Fig. 12

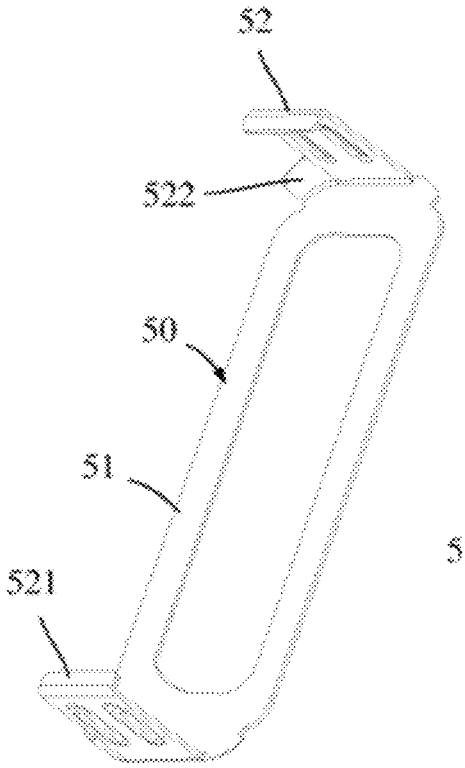
Fig. 13a
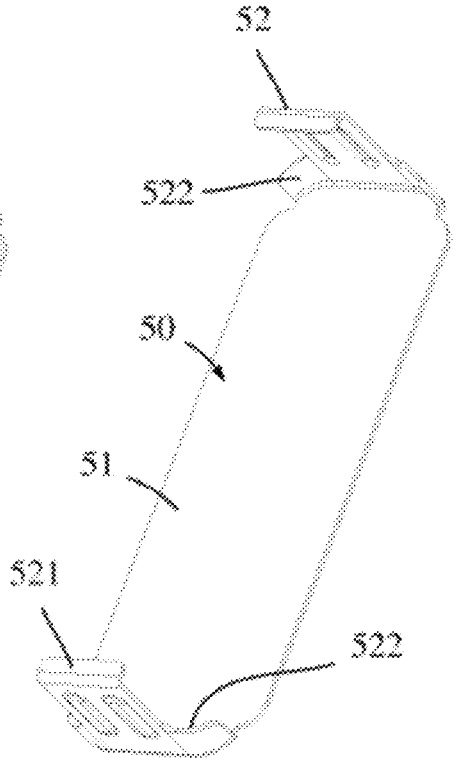
Fig. 13b
Fig. 13
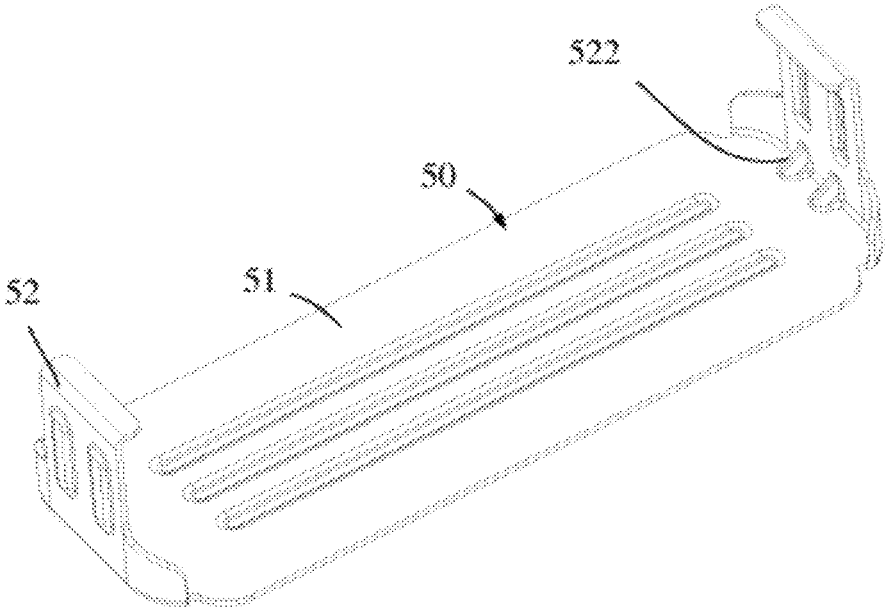
Fig. 14

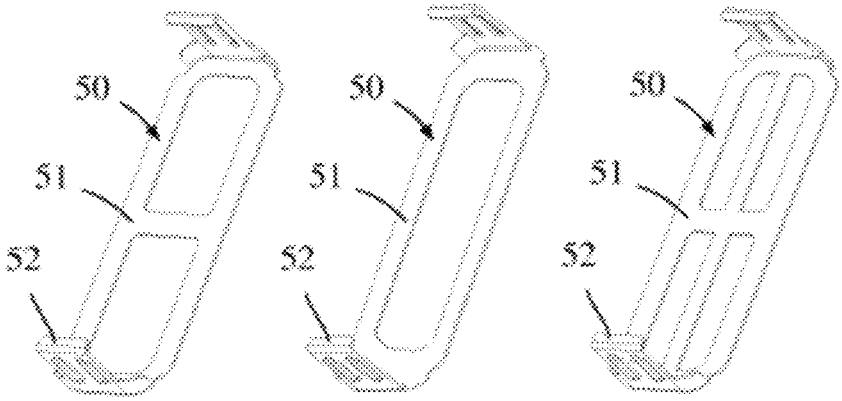
Fig. 15a Fig. 15b Fig. 15c
Fig. 15
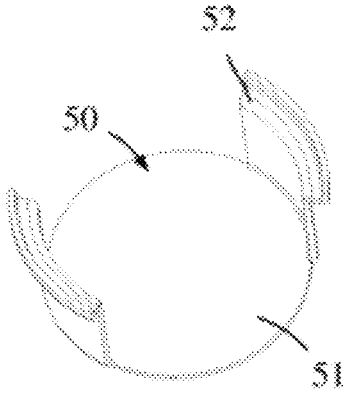
Fig. 16

SOUND PRODUCTION DEVICE AND PORTABLE TERMINAL

CROSS-REFERENCE TO RELATED APPLICATION

This application. is a National Stage of International Application No. PCT/CN2018/125759, filed on Dec. 29, 2018, which claims priority to to Chinese Patent Application No. 201810667263,6, filed on Jun. 25, 2018, both of which are hereby incorporated by reference in its entirety.

TECHNICAL FIELD

The present invention relates to the technical field of electro-acoustic, in particular to a sound production device and a portable terminal.

BACKGROUND

At present, a sound production device has been widely applied as an important component of a terminal with audio play function. Some terminals, in particular portable terminals such as mobile phones, tablet personal computers and earphones, can provide a quite limited mounting space for a sound production device, so that the sound production device has a smaller and smaller volume.

For an existing sound production device, a housing thereof is an independent plastic part and is usually bonded with a magnetic yoke. However, as the sound production device is smaller in volume, it is quite troublesome to bond the magnetic yoke to the housing, which leads to a great inconvenience for assembling the sound production device and a somewhat limited magnetic circuit space.

SUMMARY

The present invention mainly aims to provide a sound production device which is designed to solve the technical problem of inconvenient assembly of the magnetic yoke and the housing in the existing sound production device.

In order to achieve the purpose, the invention provides a sound production device, comprising a vibration system and a magnetic circuit system, the vibration system and the magnetic circuit system being mounted and fixed to an housing, characterized in that the housing comprises a first shell and a second shell that are connected and fixed together, the vibration system comprises a first diaphragm and the magnetic circuit system comprises a magnetic yoke, and wherein the first diaphragm is mounted on one surface of the first shell far away from the second shell, and the magnetic yoke and the second shell are injection molded integrally.

Optionally, the magnetic circuit system further comprises a central magnetic circuit portion and a side magnetic circuit portion, a magnetic gap being, formed between the central magnetic circuit portion and the side magnetic circuit portion;

the central magnetic circuit portion comprises a central magnet arranged on the magnetic yoke and a central concentrating flux plate arranged on the central magnet, the side magnetic portion comprises a side concentrating flux plate arranged separated from the central concentrating flux plate, and die side concentrating flux plate is fixed to the first shell by injection molding.

Optionally, the side magnetic circuit portion further comprises a first side magnet and a second side magnet that are arranged on two opposite sides of the central magnet respectively, and the side concentrating flux plate comprises a first side concentrating flux plate and a second side concentrating flux plate that are arranged on the first side magnet and the second side magnet respectively.

Optionally, the magnetic yoke is in a flat plate shape and is arranged to form a bottom wall of the second shell.

Optionally, the side, facing the second shell, of the first shell is provided with a recess/protrusion structure, and the side, facing the first shell, of the second shell is provided with a matching protrusion/recess structure; the first shell and the second shell are positioned through the snatched protrusion and recess structures, and the first shell and the second shell are bonded and fixed together by gluing.

Optionally, the first shell is provided with a first electric connector and a second electric connector for electrically connecting a voice coil of the vibration system to an external circuit, and the first electric connector and the second electric connector are connected to two leads of the voice cod of the vibration system respectively.

Optionally, the first shell is arranged in a rectangular shape, and the first electric connector and the second electric connector are arranged at one end of a short edge of the first shell.

Optionally, one end of the short edge of the first shell protrudes outwardly with a mounting protrusion portion;

the first electric connector is provided with a first bonding pad and a second bonding pad that are exposed on the mourning protrusion portion and located on an inner side of the first shell respectively; and the second electric connector is provided with a third bonding pad and a fourth bonding pad that are exposed on the mounting protrusion portion and located on the inner side of the first shell respectively;

the first bonding pad and the third bonding pad are electrically connected to an external circuit.

Optionally, the first shell is further provided with a third electric connector and an electric adapter, the third electric connector being arranged on one end of the first shell far away from the mounting protrusion portion, and two ends of the electric adapter being connected to the third electric connector and the second electric connector respectively;

one lead of the voice coil is electrically connected to the second electric connector by passing through the third electric connector and the electric adapter sequentially while the other lead of the voice coil is electrically connected to the first electric connector.

The third electric connector is provided with a fifth bonding pad exposed on an upper side surface of the first shell and a sixth bonding pad exposed on a lower side surface of the first shell, the second bonding pad being exposed on the upper side surface of the first shell, the fourth welding pond being exposed on the lower side surface of the first shell, and the sixth bonding pad and the fourth bonding pad being arranged close to the same long edge of the first shell;

two ends of the electric adapter are connected to the sixth bonding pad and the fourth bonding pad respectively;

two leads of the voice coil are connected to the fifth bonding pad and the second bonding pad respectively Optionally, the lower side surface of the first shell is provided with a lead slot extending from the sixth bonding pad to the fourth bonding pad, the electric adapter being buried in the lead slot.

The vibration system further comprises a second diaphragm arranged opposite to the first diaphragm, the second diaphragm being mourned on a surface of the second shell far away from the first shell, and the voice coil of the vibration system being arranged on a lower side of the first diaphragm;

the magnetic circuit system is arranged between the first diaphragm and the second diaphragm, the magnetic circuit system and the first diaphragm form a first sound cavity therebetween, and the voice coil partially extending into the magnetic gap of the magnetic circuit system, and the magnetic circuit system and the second diaphragm form a second sound cavity therebetween, and the first sound cavity and the second sound cavity acre provided with a gas port therebetween.

Optionally, the sound production device further comprises a connector, the connector being at least partially arranged in the gas port, being fixedly connected to the first diaphragm with an upper end of the connector and being fixedly connected to the second diaphragm with a lower end of the connector.

Optionally, the gas port comprises a plurality of side gas ports disposed in the second shell, being in communication with the magnetic gap of the magnetic circuit system to the second sound cavity, and being spaced apart along a circumferential direction of the magnetic gap;

the connector comprises a connecting bottom plate and a plurality of connecting protrusion portions protruding from the connecting bottom plate, the connecting bottom plate being arranged between the second shell and the second diaphragm and being fixedly connected to the second diaphragm, and the plurality of connecting protrusion portions passing through the side gas ports in a one correspondence manner to be fixedly connected to the first diaphragm.

Optionally, the connecting protrusion portions are arranged in plate shapes, and the connecting protrusion portions are formed with connecting flanges that are bent inward, or outward, or partially inward and partially outward at upper ends thereof; and or the connecting protrusion portions are arranged in plate shapes, and lower ends of side edges of the connecting protrusion portions are bent inward to form side reinforcement portions connected to the connecting bottom plate; and/or the lower ends of the inner sides of the connecting protrusion portions are provided with reinforcing ribs connected to the connecting bottom plate; and/or the connecting bottom plate is hollowed out; and/or the connecting protrusion portions are arranged in plate shapes and are hollowed out; and/or the connecting bottom plate is arranged in a square, round, racetrack or elliptic shape.

Optionally, the first diaphragm comprises a first central portion, a first corrugated rim arranged around the first central portion and a first fixation portion arranged around the first corrugated rim, the connecting protrusion portions being fixed to a lower side of the first central portion, the first corrugated rim being a structure formed by one protrusion or being a wavy structure formed by at least one protrusion and at least one recess; and/or the second diaphragm comprises a second central portion, a second corrugated rim arranged around the second central portion and a second fixation portion arranged around the second corrugated rim, the connecting bottom plate being fixed to an upper side of the second central portion, the second corrugated rim being a structure formed by one protrusion or being a wavy structure formed by at least one protrusion and at least one recess.

Optionally, the first diaphragm further comprises a first reinforcement portion combined to the first central portion, the first reinforcement portion being provided with a first notch at periphery thereof corresponding to a bonded part of the connecting protrusion portion and the first central portion; and/or the second diaphragm further comprises a second reinforcement portion combined to the second central portion, the second reinforcement portion being provided with a second notch at periphery thereof corresponding to a bonded part of a periphery of the connecting bottom plate and the second central portion.

Optionally, the connector is a structure formed by bending and extending a second reinforcement portion combined to the second diaphragm integrally toward a direction close to the second diaphragm/voice coil;

or, the voice coil is wound on a voice coil framework, the connector being a structure formed by bending and extending the voice coil framework integrally toward a direction close to the second diaphragm second reinforcement portion.

Optionally, the gas port comprises a central gas port penetrating middle positions of the magnetic yoke and the magnetic circuit system.

The present invention further provides a portable terminal, comprising a housing provided with an accommodation cavity internally, characterized in that the portable terminal further comprises the sound production device, the sound production device being mounted in the accommodation cavity, and the housing being provided with a first sound hole corresponding to the first diaphragm and a second sound hole corresponding to the second diaphragm.

Optionally, the housing is provided with a front surface and a back surface that are arranged oppositely, the first sound hole being disposed in the front surface and the second sound hole being disposed in the back surface.

According to the sound production device, by fixing the magnetic yoke to the second shell by injection molding, the magnetic yoke and the second shell become an independent part which is integrally arranged, so that it can reduce the assembling process of the magnetic yoke and the housing and therefore solve the problem that it is inconvenient to assemble the magnetic yoke and the housing; especially tilt the sound production device which is relatively small in volume, the assembling efficiency thereof can be improved greatly. Meanwhile, compared with the way of bonding the magnetic yoke to the housing, the present invention can improve, by fixing the magnetic yoke to the second shell by injection molding, the connecting strength between the magnetic yoke and the second shell and thus improve the connecting strength between the magnetic yoke and the housing to prevent looseness, such that it can improve the reliability of the sound production device product. In addition, in the present invention a conventional plastic housing is split into two shells which are assembled together along an assembling direction, and thus compared with the prior art, it can provide a bigger space the magnetic circuit system and further improve the product performance.

BRIEF DESCRIPTION OF THE DRAWINGS

In order to illustrate embodiments of the present invention or technical solutions in the prior art more clearly, brief introduction on drawings needed to be used in description of the embodiments or the prior art is made below. It is obvious that the drawings described below are merely some embodiments of the present invention and structures shown in those drawings can be used as a basis to obtain other drawings by those skilled in the art without creative efforts.

FIG. 11 is a structural schematic view of a magnetic circuit system of the sound production device of the present invention;

FIG. 12 is a structural schematic view of a second embodiment of a connector the sound production device of the present invention;

FIG. 13 is a structural schematic view of a third embodiment of a connector of the sound production device of the present invention;

FIG. 14 is a structural schematic view of a fourth embodiment of a connector of the sound production device of the present invention;

FIG. 15 is a structural schematic view of a fifth embodiment or a sixth embodiment of a connector of the sound production device of the present invention;

FIG. 16 is a structural schematic view of a seventh embodiment of a connector Of the sound production device of the present invention;

DESCRIPTION OF REFERENCE NUMBERS

Figure 1:
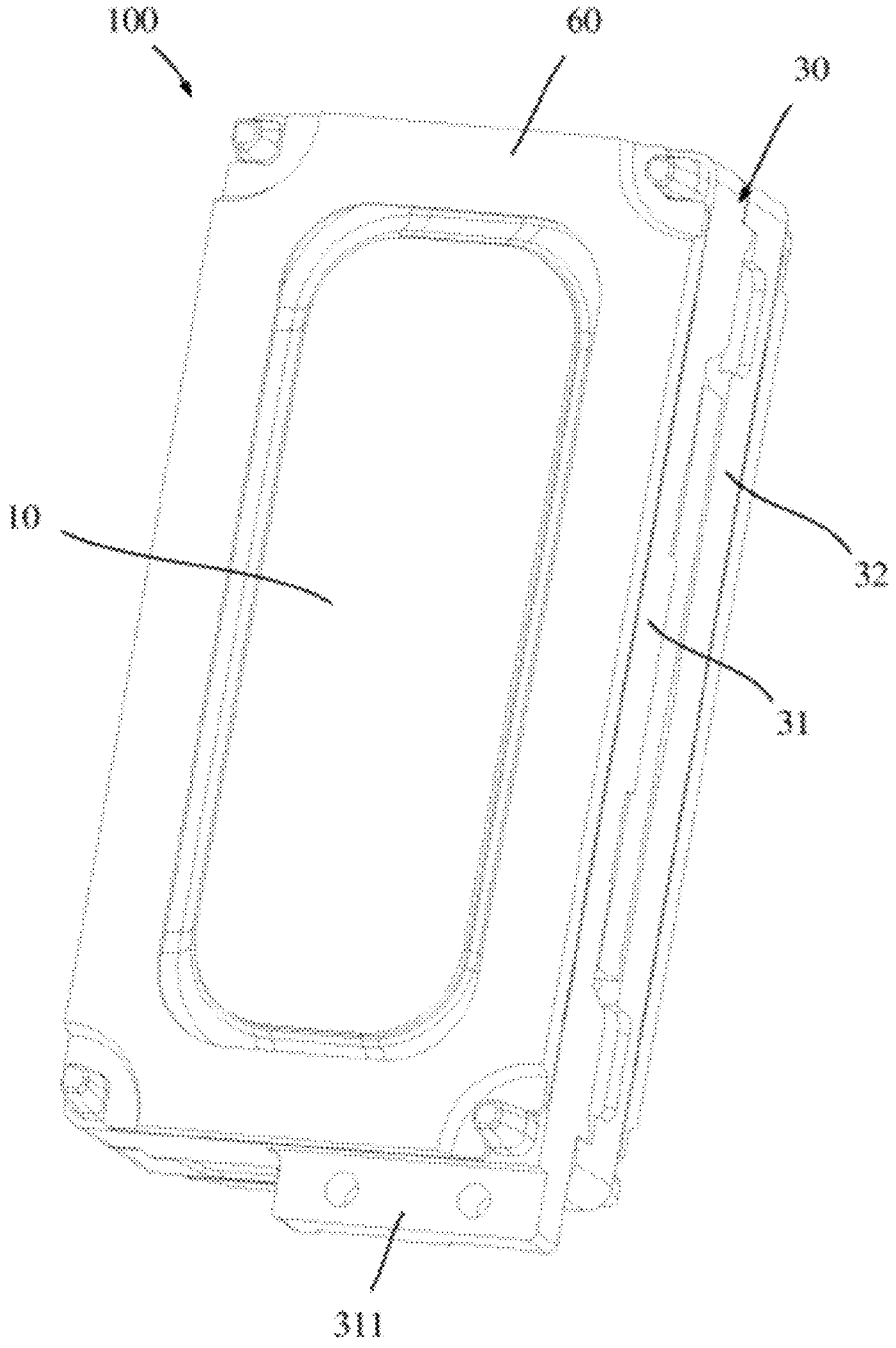
FIG. 1 is a schematic view of a front structure of an embodiment of a sound production device of the present invention.

| Number | Name | Mark number | Name |
|---|---|---|---|
| 100 | sound production device | 311 | mounting protrusion portion |
| 10 | vibration system | 312 | lead slot |
| 11 | first diaphragm | 32 | second shell |
| 111 | first central portion | 33 | third sound hole |
| 112 | first corrugated rim | 34 | damp |
| 113 | first fixation portion | 41 | first electric connector |
| 114 | first reinforcement portion | 411 | first bonding pad |
| 1141 | first notch | 412 | second bonding pad |
| 12 | second diaphragm | 42 | second electric connector |
| 121 | second central portion | 421 | third bonding pad |
| 171 | second corrugated rim | 422 | fourth bonding pad |

-continued

| Number | Name | Mark number | Name |
|---|---|---|---|
| 123 | second fixation portion | 43 | third electric connector |
| 124 | second reinforcement portion | 431 | third bonding pad |
| 1241 | second notch | 432 | sixth bonding pad |
| 13 | voice coil | 44 | electric adapter |
| 10 | magnetic circuit system | 50 | connector |
| 21 | magnetic yoke | 51 | connecting bottom plate |
| 22 | magnetic gap | 52 | connecting protrusm portion |
| 23 | central magnet | 521 | cotmectino illnoimt |
| 24 | central concentrating flux plate | 522 | side reinrorcement portion |
| 25 | side concentrating flux plate | 523 | reinforcing rib |
| 251 | first side concentniting flux plate | 60 | from cover |
| 252 | second side concentrating flux plate | 70 | back cover |
| 26 | first side magnet | 1000 | portable terminal |
| 27 | second side magnet | 200 | shell |
| 28 | side gas port | 201 | accommodation cavity |
| 30 | housing | 202 | First sound hole |
| 31 | first shell | 203 | second sound hole |

Implementation of purposes, functional characteristics and advantages of the present invention will be further described in combination with embodiments with reference to drawings.

DETAILED DESCRIPTION

Clear and intact description on the technical solution in the embodiments of the present invention will be made in combination with drawings in the embodiments of the present invention. It is obvious that the embodiments described are only a part of embodiments of the present invention, and are not all of embodiments thereof. Based on the embodiments of the invention, all the other embodiments obtained by those of ordinary skill in the art without inventive effort are within the scope of the invention.

It should be noted that all directional indications (for example, upper, lower, left, right, front, rear and etc.) in the embodiments are merely used for explaining relative position relationships and moving conditions and etc among parts in a certain special gesture (as shown in the drawings). The directional indications change as well therewith when the special gesture changes.

In addition, the descriptions of "first", "second" and the like in the present disclosure are used for the purpose of description only, and are not to be construed as indicating or implying their relative importance or implicitly indicating the number of technical features indicated, Thus, features defined with "first", "second" may include at least one such feature, either explicitly or implicitly. Furthermore, the technical solutions between the various embodiments may he combined with each other, but must be on the basis that the combination thereof can be implemented by a person of ordinary skill in the art. In case of a contradiction with the combination of the technical solutions or a failure to implement the combination, it should be considered that the combination of the technical solutions does not exist, and is not within the protection scope of the present invention.

The present invention provides a sound production device.

In the embodiment of the present invention, as shown in FIG. 1 to FIG. 8, the sound production device 100 comprises a vibration system 10, a magnetic circuit system 20 and an auxiliary system. The auxiliary system comprises a housing 30 with the vibration system 10 and the magnetic circuit system 20 mounted thereon and including a first shell 31 and a second shell 32 connected and fixed to each other. The vibration system comprises a first diaphragm 11, which is mounted on a surface of the first shell 31 far away from the second shell 32. The magnetic circuit system 20 comprises a magnetic yoke 21 which is injection molded into one with the second shell 32.

It can be understood that the sound production device 100 allows, by fixing the magnetic yoke 21 onto the second shell 32 by injection molding, the magnetic yoke 21 and the second shell 32 to be an integral part and thus may reduce the assembling process for the magnetic yoke 21 and the housing 30, and therefore solves the problem that it is inconvenient to assemble the magnetic yoke 21 and the housing 30; in particular for the sound production device 100 which is relatively small in volume, it can greatly improve the assembling efficiency thereof. Meanwhile, compared with the way of bonding the magnetic yoke 21 to the housing 30, the present invention may improve, by fixing the magnetic yoke 21 to the second shell 32 by injection molding, the connecting strength between the magnetic yoke 21 and the second shell 32, and thus may improve the connecting strength between the magnetic yoke 21 and the housing 30 o prevent looseness, which may improve the reliability of the sound production device 100 product, and thus may improve the quality of the sound production device 100 and the portable terminal.

Further, as shown in FIG. 3 to FIG. 5 and FIG. 11, the magnetic circuit system 20 further comprises a central magnetic circuit portion and a side magnetic circuit portion with a magnetic gap 22 formed therebetween; the central magnetic circuit portion comprises a central magnet 23 arranged on the magnetic yoke 21 and a central concentrating flux plate 24 arranged on the central magnet 23, and the side magnetic portion comprises a side concentrating flux plate 25 arranged separated from the central concentrating flux plate 24 and fixed to the first shell 31 by injection molding.

Compared with the way of bonding e side concentrating flux plate onto the housing 30 in the prior art, the sound production device 100 of the present invention allows, by fixing the side concentrating flux plate 25 onto the first shell 31 by injection molding, the side concentrating flux plate 25 and the first shell 31 to be an integral part and thus may reduce the assembling process for the side concentrating flux plate 25 and the housing 30, and therefore solves the problem that it is inconvenient to assemble the side concentrating flux plate 25 and the housing 30; in particular for the sound production device 100 which is relatively small in volume, it may greatly improve the assembling efficiency thereof. Meanwhile, compared with the way of directly bonding the side concentrating flux plate 25 to the housing 30, the present invention may improve, by fixing the side concentrating flux plate 25 onto the first shell 31 by injection molding, the connecting strength between the side concentrating flux plate 25 and the first shell 31 and thus may improve the connecting strength between the side concentrating flux plate 25 and the housing 30 to prevent looseness, which may further improve the reliability of the sound production device 100 product.

Further, as shown in. FIG. 3 to FIG. 5 and FIG. 11, the side magnetic circuit portion further comprises a first side magnet 26 and a second side magnet 27 arranged on opposite two sides of the central magnet 23 respectively, and the side concentrating flux plate 25 comprising a first side concentrating flux plate 251 and a second side concentrating flux plate 252 arranged on the first side magnet 26 and the second side magnet 27 respectively. That is, the magnetic circuit system 20 of the sound production device 100 is arranged as a tri-magnet magnetic circuit system with the magnetic gap 22 thereof formed between the central magnet 23 and the side magnet.

Figure 8:
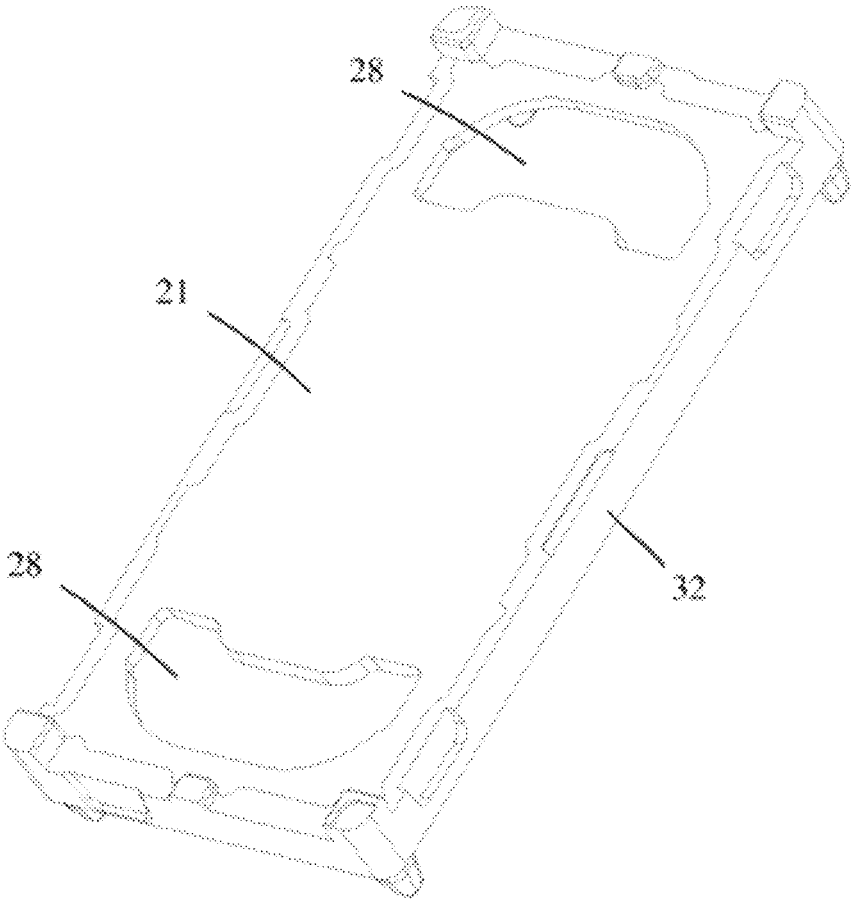
FIG. 8 is a structural schematic view of the second shell in FIG. 7.

Further, as shown in FIG. 8 and FIG. 11, the magnetic yoke 21 is in a plate shape and is provided as a bottom wall of the second shell 32. Thus, not only can the magnetic yoke 21 be easily fixed to the second shell 32 by injection molding, but also, by providing the magnetic yoke 21 as the bottom wall of the second shell 32, can the magnetic yoke be increased in its thickness as far as possible on the premise of not increasing the thicknesses of the second shell 32 and the housing 30. In this way, it can improve the magnetic effect of the magnetic yoke 21, and meanwhile facilitate achieve miniaturized design of the sound production device 100. Further, the housing is split into two shells and thus compared with the prior art, can increase the space of the magnetic circuit and further enhance the acoustic performance of the product.

In the embodiment, the housing 30 is substantially in a rectangular shape and the magnetic yoke 21 is also substantially in a rectangular shape. The first side magnet 26 and the second side magnet 27 are arranged on two long edge sides of the magnetic yoke 21 respectively.

In particular, as shown in FIG. 11, the central magnet 23, the first side magnet 26 and the second side magnet 27 each is bonded to the upper side surface of the second shell 32.

Further, as shown in FIG. 7 to FIG. 11, the first shell 31 is provided with recess/protrusion structures at a surface facing the second shell 32 (distributed at four corners specifically), and the second shell 32 is provided with matching protrusion. recess structures at a side facing the first shell 31 (distributed at four corners correspondingly), and the first shell 31 and the second shell 32 are positioned through the matched protrusion and recess structures. Further, the first shell 31 and the second shell 32 can be bonded and fixed together by gluing. Thus, it is convenient to assemble the two shells and position them accurately. Specifically, the positioning structure can be arranged as a positioning column structure.

Figure 2:
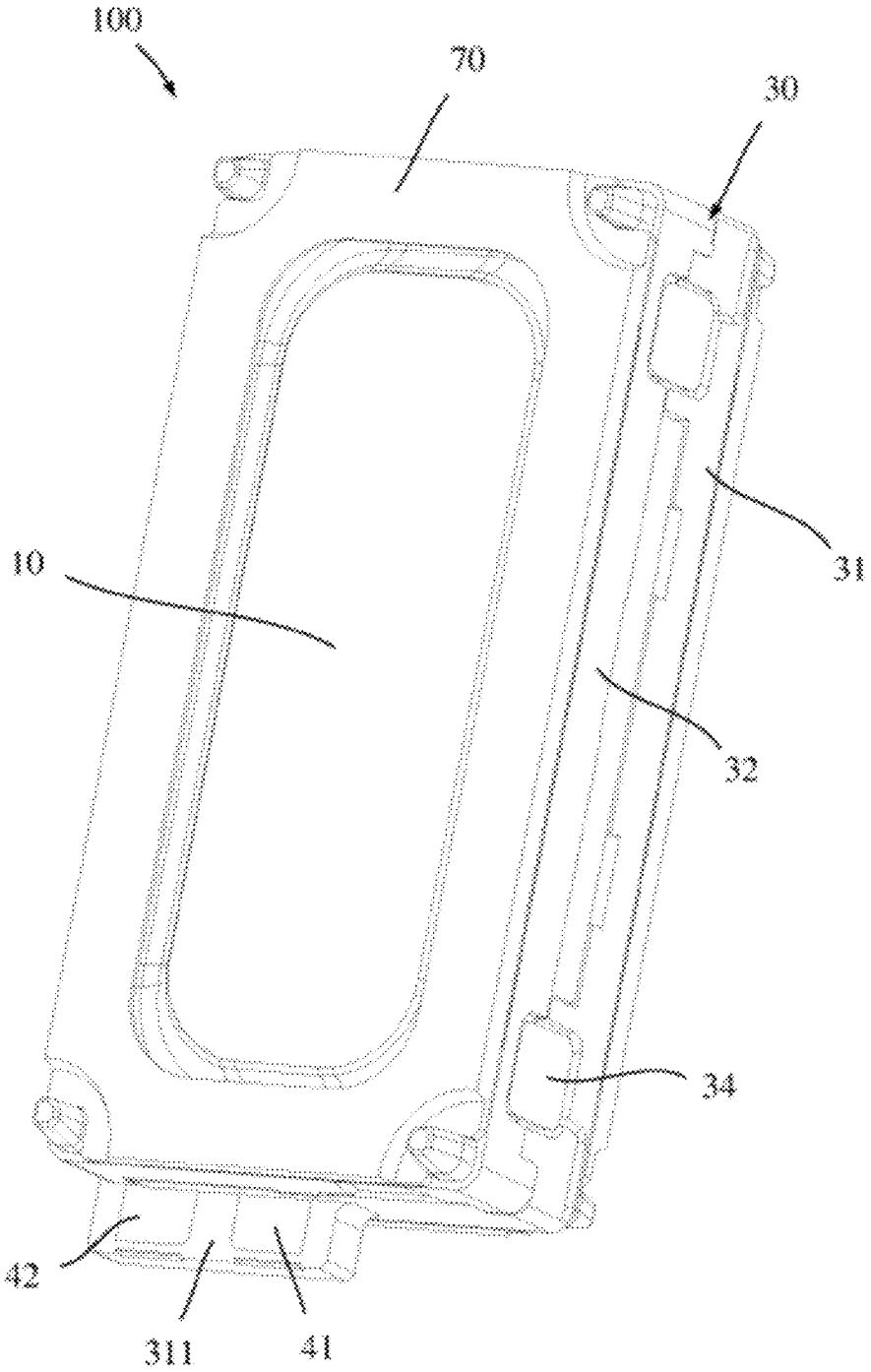
FIG. 2 schematic view of back structure of the sound production device in FIG. 1.
Figure 7:
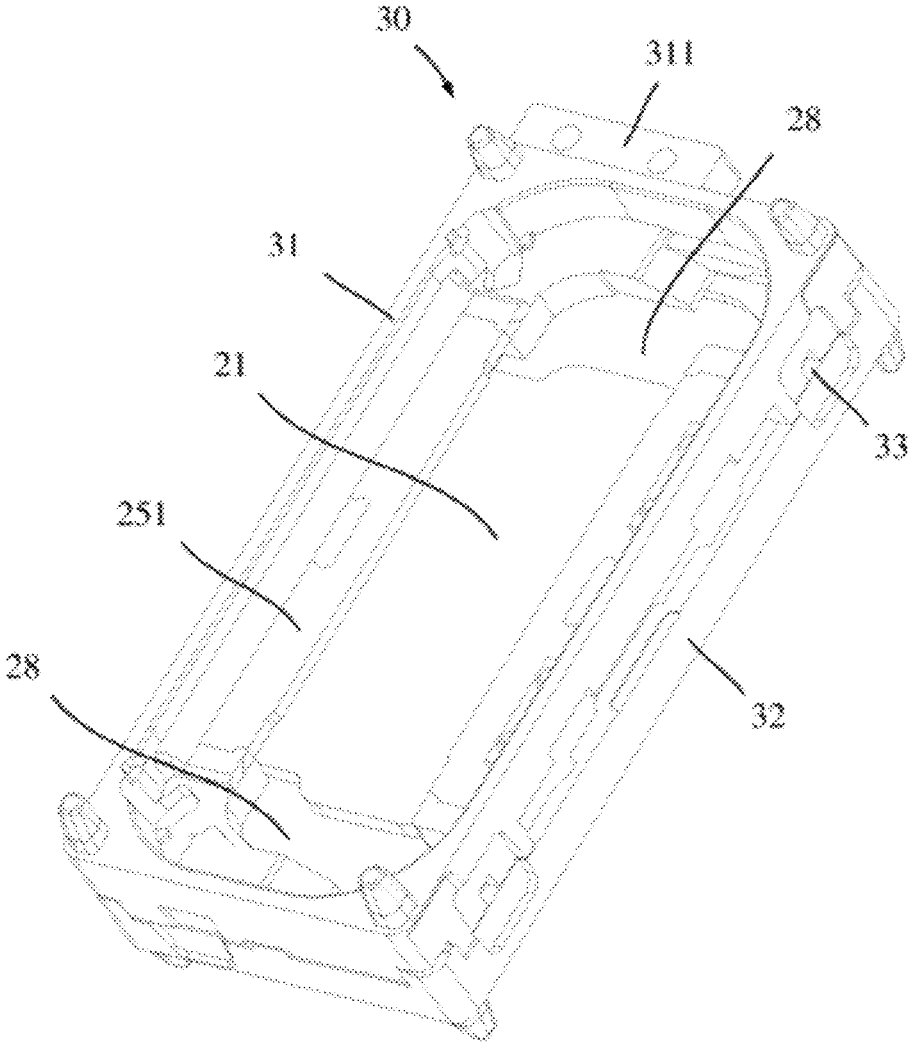
FIG. 7 is a structural schematic view of the housing in FIG. 1.

Further, as shown in FIG. 2 and FIG. 7, there is a third sound hole 33 formed at a splice-site of the first shell 31 and the second shell 32, and the third sound hole 33 is in communication to a sound cavity in the sound production device 100; and there is a damp 34 bonded to the third sound hole 33. Thus, it can balance internal and external air pressures and temperatures of the sound production device 100 to ensure normal work of the sound production device 100.

In the embodiment, two third sound holes 33 are disposed and are disposed in long edge sides of the housing 30 respectively.

Surely, the magnetic circuit system 20 of the sound production device 100 can be also arranged as a single magnet magnetic circuit system. For example, in other embodiments of the present invention, the magnetic yoke 21 comprises a bottom wall and a side wall arranged on a periphery of the bottom wall, the bottom wall of the magnetic yoke 21 is fixed to the second shell 32 by injection molding and is arranged as the bottom wall of the second shell 32, the side concentrating flux plate 25 is arranged on the side wall of the magnetic yoke 21, and the magnetic gap 22 is formed between the central magnet 23 and the side wall of the magnetic yoke 21. Detailed description is not repeated herein.

Figure 9:
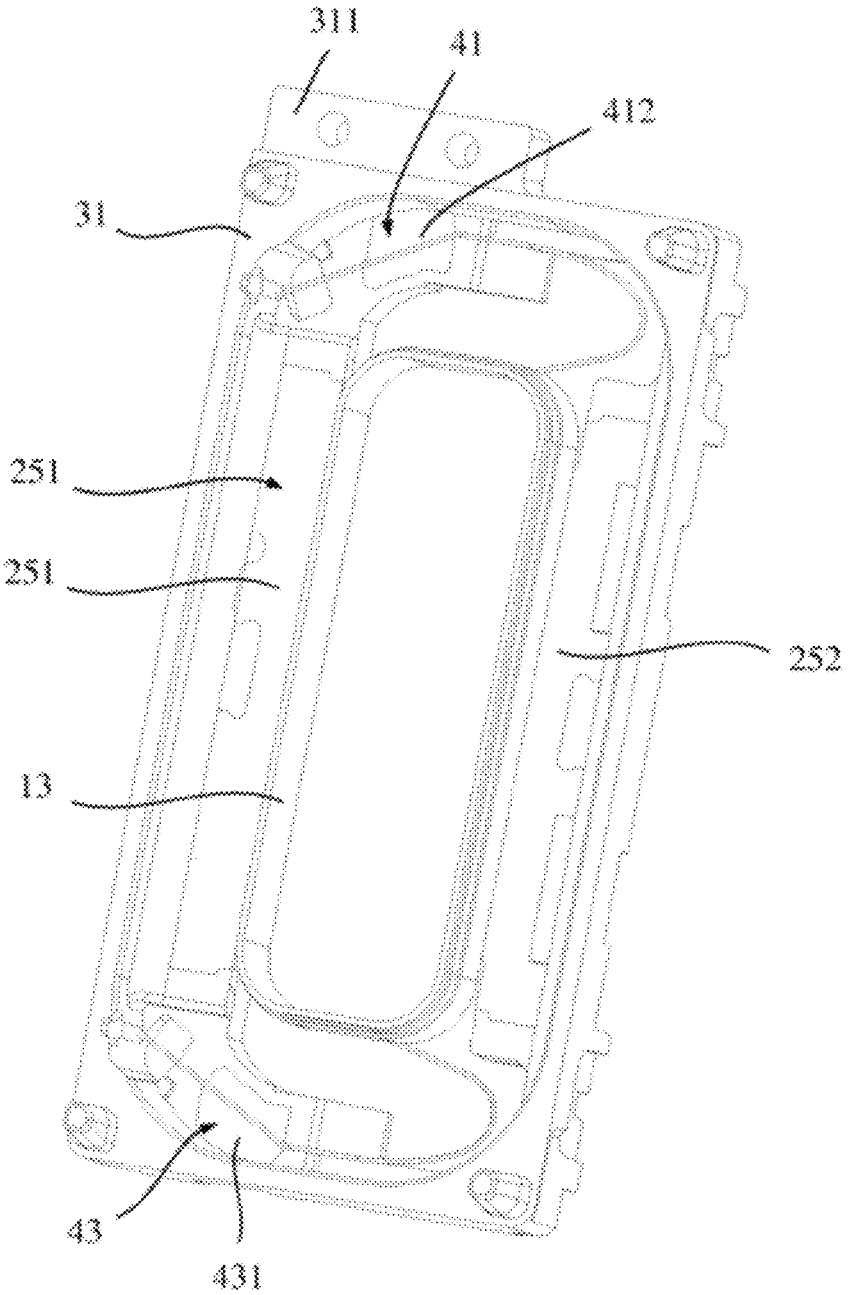
FIG. 9 is a schematic view of a front structure when a voice coil of the sound production device of the present invention is mounted on the first shell thereof.
Figure 10:
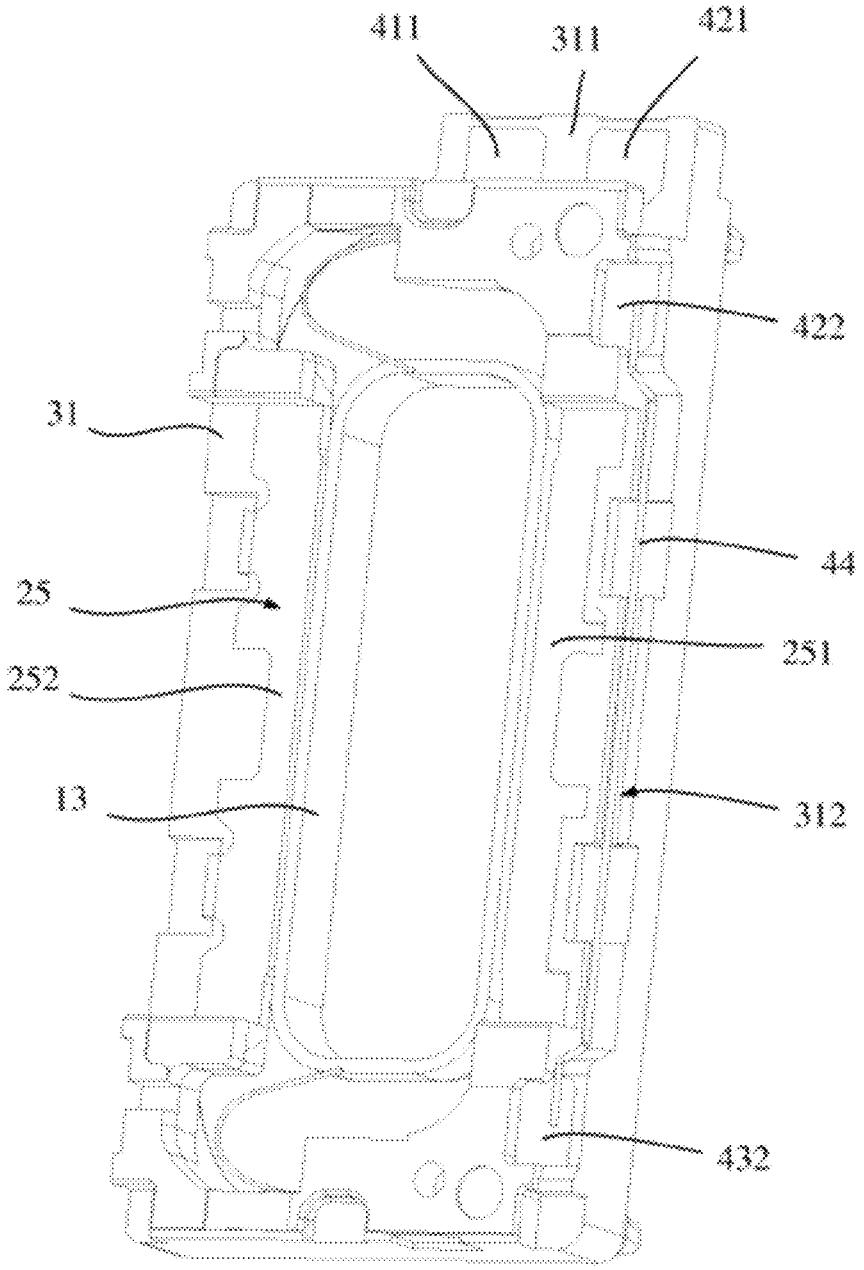
FIG. 10 is a schematic view of a back structure when the voice coil is mounted on the first shell as shown in FIG. 9.
Figure 17:
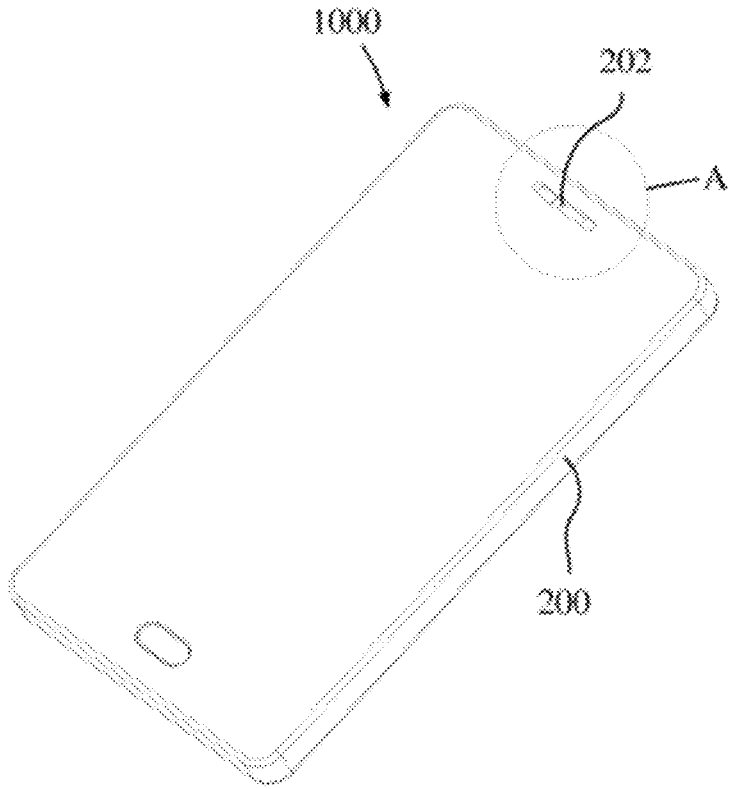
FIG. 17 is a schematic view of a front structure of an embodiment of a portable terminal of the present invention.
Figure 18:
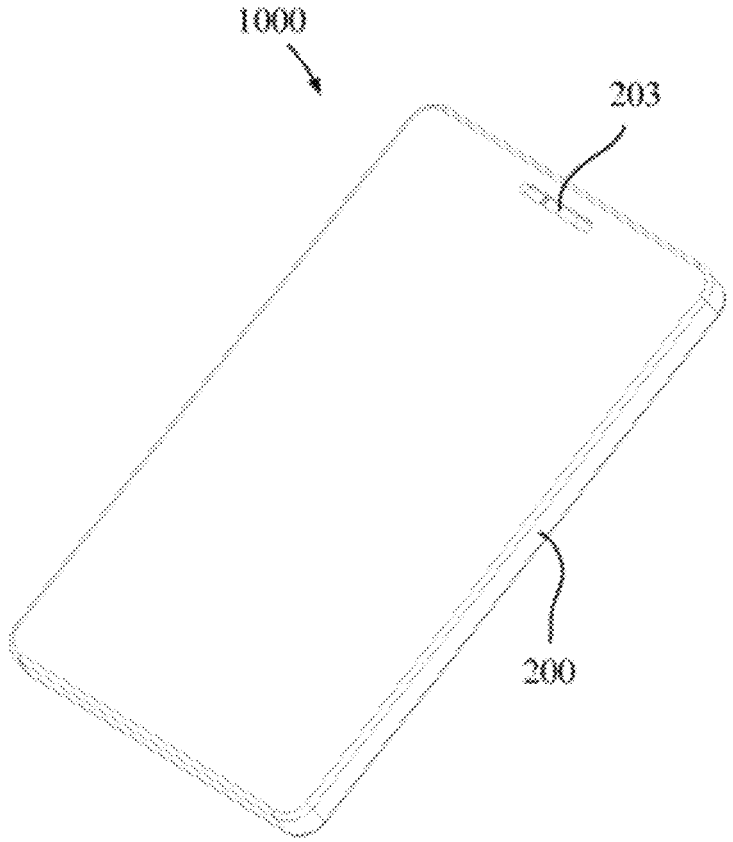
FIG. 18 is a schematic view of a back structure of the portable terminal in FIG. 17.
Figure 19:
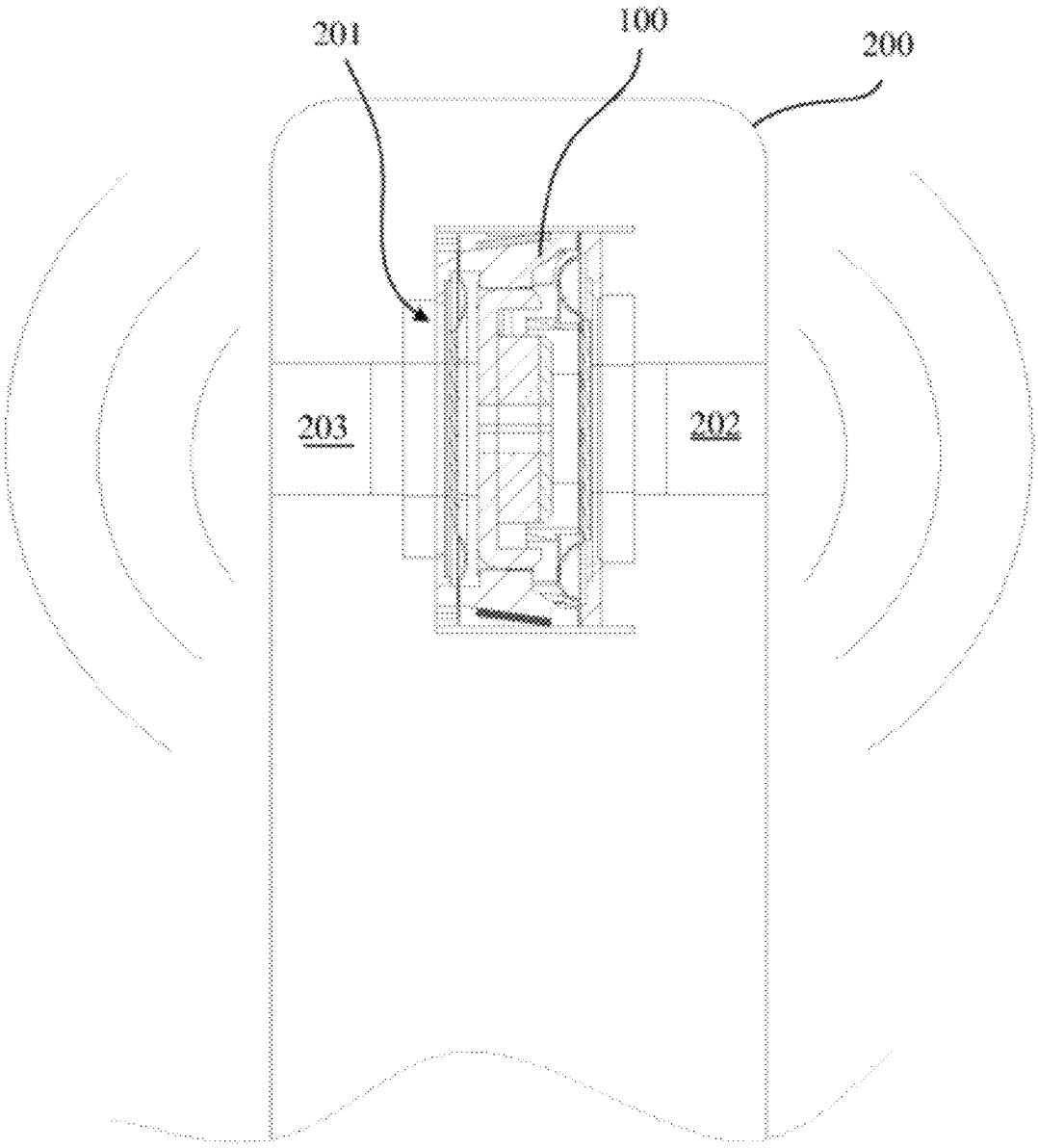
FIG. 19 is schematic view of a partial cross-sectional structure at A in FIG. 17.

Further, as shown in FIG. 2. FIG. 9 and FIG. 10, at the outer side of the housing 30, it is provided with a first electric connector 41 and a second electric connector 42 for connecting the voice coil 13 of the vibration system 10 to an external circuit and connected to two leads of the voice coil 13 of the vibration system 10 respectively. Thus, by means of the design of splitting the housing 30 and arranging an electric connecting point of the voice coil 13 and the external circuit outside the housing 30, it can provide a bigger space to the magnetic circuit system 20 and thus improve the acoustic performance of the sound production device 100. Meanwhile, it is beneficial to increasing the effective radiative area of the diaphragm and thus allows the sound production device 100 to obtain better acoustic performance.

Further, as shown in FIG. 2, FIG. 9 and FIG. 10, the first electric connector 41 and the second electric connector 42 are arranged at one end of the short edge of the housing 30 to be convenient to assemble and use the sound production device 100 and the portable terminal 1000.

In particular, as shown in FIG. 9 and FIG. 10, in order to connect the first electric connector 41 and the second electric connector 42 to the external circuit, one end of the short edge of the first shell 31 protrudes outwardly with a mounting protrusion portion 311, the first electric connector 41 is provided with a first bonding pad 411 exposed to the mounting protrusion portion 311, the second electric connector 42 is provided with a third bonding pad 421 exposed to the mounting protrusion portion 311, and the first bonding pad 411 and the third bonding pad 421 are electrically connected to the external circuit.

In order to electrically connect the first electric connector 41 and the second electric connector 42 to the voice coil 13 of the vibration system 10, the first electric connector 41 is further provided with a second bonding pad 412 exposed to the first shell 31, the second electric connector 42 is further provided with a fourth bonding pad 422 exposed to the first shell 31, and two leads of the voice coil 13 are electrically connected to the second bonding pad 412 and the fourth bonding pad 422 respectively.

Further, as shown in FIG. 9 and FIG. 10, the first shell 31 is further provided with a third electric connector 43 and an electric adapter 44, the third electric connector 43 being arranged on one end of the first shell 31 far away from the mounting protrusion portion 311, and two ends of the electric adapter 44 being connected to the third electric connector 43 and the second electric connector 42 respectively; and one lead of the voice coil 13 is electrically connected to the second electric connector 42 through the third electric connector 43 and the electric adapter 44 orderly while the other lead of the voice coil 13 is electrically connected to the first electric connector 41.

Therefore, only three electric connectors 50 are needed to lead the electric connection point of the voice coil 13 and the external circuit to the outer side of the first shell 31, so that the first shell 31 is simple in structure and convenient to manufacture.

Further, as shown in FIG. 9 and FIG. 10, the third electric connector 43 is provided with a fifth bonding pad 431 exposed to the upperside surface of the first shell 31 and a sixth bonding pad 432 exposed to the lowerside surface of the first shell 31, the second bonding pad 412 being exposed to the upperside surface of the first shell 31, the fourth bonding pad 422 being exposed to the lowerside surface of the first shell 31, and the sixth bonding pad 432 and the fourth bonding pad 422 being arranged close to the same long edge of the first shell 31; two ends of the electric adapter 44 are connected to the sixth bonding rad 432 and the fourth bonding pad 422 respectively; and two leads of the voice coil 13 are connected to the fifth bonding pad 431 and the second bonding pad 412 respectively, in particular, the mounting protrusion portion 311 is further arranged close to one long edge of the first shell 31 so as to play a role of structure fool-proofing.

It can be understood that by separately connecting the two leads of the voice coil 13 to the fourth bonding pad 422 and the fifth bonding pad 431 arranged at two ends of the first shell 31, the broken risk of leads of the voice coil 13 when the sound production device 100 works can be reduced, and meanwhile, the noise problem caused by the leads of the voice coil can be weakened or even eliminated.

In particular, as shown in FIG. 9 and FIG. 10, the first shell 31 is formed with a lead slot 312 at the lowerside surface thereof extending to the fourth bonding pad 422 from the sixth bonding pad 432, and the electric adapter 44 is buried in the lead slot 312. After the first shell 31 and the second shell 32 are assembled, the second shell 32 covers the notch of the lead slot 312 and the second shell 32 covers the fourth bonding pad 422 and the sixth bonding pad 432, so that a condition that a conductive circuit of the voice coil 13 in the housing 30 is damaged due to external factors can be avoided.

In particular, the first electric connector 41, the second electric connector 42, the third electric connector 43 and the electric adapter 44 can be integrated to the first shell 31 first, and meanwhile, the central magnet and the side magnets are bonded to the second shell 32, then the first shell 31 and the second shell 32 are spliced and assembled to form the housing 30, and then the two leads of the voice coil 13 can be welded to the fourth bonding pad 422 and the fifth bonding pad 431. Thus, it reduces the assembling difficulty so as to improve the production efficiency of the sound production device 100, shorten the production period of the sound production device 100, and further increase the magnetic circuit space and improve the acoustic performance of the product.

In the embodiment, the electric adapter 44 can be arranged as a lead wire, a varnished wire or a thickened varnished wire and the like.

Further, the sound production device 100 of the present invention can be either a single diaphragm sound production device 100 or a double diaphragm sound production device 100. When the sound production device 100 of the present invention is arranged as the single diaphragm sound production device 100, reference can be made to the structural form of the single diaphragm sound production device 100 and the embodiments of the present invention. Thus, it is unnecessary to elaborate herein.

In some embodiments provided by the present invention, the sound production device 100 is arranged as the double diaphragm. In particular, as shown in FIG. 1 to FIG. 8, the vibration system 10 comprises a first diaphragm 11 and a second diaphragm 12 arranged oppositely, the second diaphragm 12 is mounted on the surface of the second shell 32 far away from the first shell 31, and the voice coil 13 of the vibration system 10 is arranged on the lower side of the first diaphragm 11.

The magnetic circuit system 20 is arranged between the first diaphragm 11 and the second diaphragm 12, a first sound cavity (not shown in Figures) being formed between the magnetic circuit system 20 and the first diaphragm 11 and the voice coil 13 partially extending into the magnetic gap 22 of the magnetic circuit system 20; and there is a second sound cavity (not shown in Figures) formed between the magnetic circuit system 20 and the second diaphragm 12, and there is an gas port disposed between the first sound cavity and the second sound cavity.

The vibrating principle of the first diaphragm 11 can refer to an existing form. In particular, the voice coil 13 is fixedly connected to the first diaphragm 11 and penetrates into the magnetic gap 22, communicates to a changing current to be subjected to Ampere forces with different amplitudes to vibrate, and vibrates to drive the first diaphragm 11 to vibrate, and the energy conversion mode thereof is electric energy-mechanical energy-acoustic energy. In order to adjust the frequency characteristic of vibration, a counterweight can be further arranged.

As to the gas port, it can be only disposed in the bottom wall of the magnetic yoke 21 to communicate the magnetic gap 22 to the second sound cavity; or can be formed in the middle position of the magnetic circuit system 20, that is, penetrating through the central concentrating flux plate 24, the central magnet 23 and the magnetic conductive 21 successively to communicate the first sound cavity to the second cavity; or can be formed in the side surface of the central magnet 23 and is bent downward in the central magnet 23 to penetrate through the bottom wall of the magnetic conductive 21 to communicate the magnetic gap 22 to the second sound cavity, as long as the first sound cavity and the second sound cavity can be communicated the flow area of the gas port is large enough to enable an airflow circulating in the gas port can push the second diaphragm 12 to produce sound.

The sound production device 100 of the present invention is relatively small in volume and is convenient to be widely applied to the portable terminal 1000, by producing sound through vibration of two diaphragms and producing sound bidirectionally by the two diaphragms by adopting a set of voice cod 13 and magnetic circuit system 20. In particular, when the sound production device 100 of the present invention works, the magnetic circuit system 20 drives the first diaphragm 11 to vibrate directly first to enable air in the first sound cavity to be compressed or expanded. As the gas port is disposed between the first sound cavity and the second sound cavity to communicate to allow air to circulate in the gas port. Pushed by the airflow, the second diaphragm 12 vibrates to produce sound driven by the airflow, and the second sound cavity expands or compresses in conjunction, thus forming a bidirectional sound production structure where the first diaphragm 11 on the front surface radiates actively and the second diaphragm 12 on the back surface radiates passively. When applied to the portable terminal 1000, the sound production device 100 of the present invention can produce sound toward forward and backward directions of the portable terminal 1000 respectively.

It can be understood that the design is driving the second diaphragm 12 to produce sound based on circulation of air in the gas port. In a further embodiment of the present invention, in order to drive the second diaphragm 12 to vibrate to produce sound, a connector 50 can be additionally arranged to connect the first diaphragm 11 and the second diaphragm 12 to drive the second diaphragm 12 to produce sound. Surely, the connector 50 may not be additionally arranged and the second diaphragm 12 is driven by circulation of air in the gas port to produce sound.

Further, as shown in FIG. 3 to FIG. 6, the sound production device 100 further comprises a connector 50, the connector 50 being at least partially arranged in the gas port, and an upper end of the connector 50 being fixedly connected to the first diaphragm 11 and a lower end of the connector being fixedly connected to the second diaphragm 12. Thus, under push or pull by the connector 50, the first diaphragm 11 will drive the second diaphragm 12 to vibrate synchronously to produce sound. Moreover, while the first diaphragm 11 and the second diaphragm 12 are linked to produce sound, as air in the first sound cavity and the second sound cavity communicate to each other through the gas port and thus there is a relatively small air pressure difference between the first sound cavity and the second sound cavity which brings a relatively small resistance to vibration of the first diaphragm 11 and the second diaphragm 12, more preferable acoustic performance can be achieved.

In particular, compared with the way of driving the second diaphragm 12 to produce sound by means of circulation of air in the gas port, when the second diaphragm 12 is driven to vibrate to produce sound through the connector 50, the specific structural form of the gas port will also change accordingly, as long as it is convenient for the connector 50 to move in the gas port to link the first diaphragm 11 and the second diaphragm 12 and an airflow channel for communicating the first sound cavity to the second sound cavity is formed between the connector 50 and the inner wall surface of the gas port.

In particular, the connector 50 and the first diaphragm 11 or the second diaphragm 12 are connected by glue bonding or by injection molding. The upper and lower ends of the connector 50 in the embodiment are bonded to the first diaphragm 11 or the second diaphragm 12 respectively.

In particular, in order to reduce the weight of the part on the premise of guaranteeing strength, a material of the connector 50 comprises, but not limited to, a carbon fiber material, a metal material such as an aluminum foil/a magnesium aluminum alloy/a magnesium lithium alloy, a plastic material such as PEN (polyethylene naphthalate)/PI (polyimide)/LCP (Liquid Crystal Polymer)/PC(polycarbonate)/PPA(Polyphthalamide), or a porous material and the like. The processing modes of the connector 50 comprise, but not limited to, winding, blow molding, injection molding, stamping, machining and the like.

As shown in FIG. 3 to FIG. 6, the present invention is illustrated by taking the way as an example, the way being that the gas port is disposed in the bottom wall of the magnetic yoke 21 to communicate the magnetic gap 22 to the second sound cavity and the connector 50 is arranged to connect the first diaphragm 11 and the second diaphragm 12 to drive the second diaphragm 12 to produce sound.

In particular, as shown in FIG. 3 to FIG. 6, the gas port comprises side gas ports 28 disposed in the second shell 12 and communicating the magnetic gap 22 of the magnetic circuit system 20 to the second sound cavity. in particular, as the magnetic yoke is taken as a part of the bottom wall of the second shell, the side gas port 28 can be disposed either in the magnetic yoke (i.e. the bottom wall of the second shell), or can be disposed in the bottom wall, except the magnetic yoke, of the second shell but specific positions are not limited. The plurality of side gas ports 28 are disposed, and the side gas ports 28 are disposed in a spaced manner along the circumferential direction of the magnetic gap 22.

The connector 50 comprises a connecting bottom plate 51 and a plurality of connecting protrusion portions 52 protruding :from the connecting bottom plate 51, the connecting bottom plate 51 being arranged between the second shell 32 and the second diaphragm 12 and fixedly connected to the second diaphragm 12, and the plurality of connecting protrusion portions 52 penetrating through the plurality of side gas ports 28 in a one-to-one correspondence manner separately and being fixedly connected to the first diaphragm 11.

Thus, the first diaphragm 11 will drive the second diaphragm 12 to vibrate synchronously to produce sound. Meanwhile, as the side gas ports 28 are disposed in the edge sides of the diaphragms, if only one connecting protrusion portion 52 is arranged, then it will lead to a relatively poor vibrating synchronism of the first diaphragm 11 and the second diaphragm 12. However, in the present invention, a plurality of connecting protrusion portions 52 are provided so as to improve the force transferring homogeneity between the first diaphragm 11 and the second diaphragm 12, and thus improve the vibrating synchronism of the first diaphragm 11 and the second diaphragm 12.

It can be understood that the more the connecting protrusion portions 52 are, the better the vibrating synchronism of the first diaphragm 11 and the second diaphragm 12 is. However, when the connecting protrusion portions 52 become more, not only the structure of the sound production device 100 is more complex but also movement of the voice coil 13 in the magnetic gap 22 is further affected greatly since the connecting protrusion portions 52 are arranged in the magnetic gap 22. Therefore, preferably, the number of the connecting protrusion portions 52 is two or three, and those are in centrosymmetry.

In the embodiment, the housing 30 is substantially rectangular and the connecting bottom plate 51 is substantially rectangular too. Preferably, the number of the connecting protrusion portions 52 is two and those are symmetrically arranged at two ends of the short edge of the connecting bottom plate 51.

Further, as shown in FIG. 12 to FIG. 15, in the first to seventh embodiments of the connector 50, the connecting protrusion portions 52 are arranged in plate shape. Thus, not only can the space occupied by the connecting protrusion portions 52 in the magnetic gap 22 be reduced, but also the structural strength can be ensured during transmission and the energy loss can be reduced by reducing the weight. Transmission of the connector 50 means that the second diaphragm 12 is pushed or pulled with reference to the first diaphragm 11.

As shown in FIG. 12, in the second embodiment of the connector 50, the connecting protrusion portions 52 are arranged in plate shapes, and are formed at the upper ends thereof with connecting flangings 521 that are bent inward, or outward, or partially inward and partially outward. Thus, it can increase the contact area between the connecting protrusion portions 52 and the first diaphragm 11, thus enhance the connecting strength between the connecting protrusion portions 52 and the first diaphragm 11, and therefore enhance the reliability of the sound production device 100.

As shown in FIG. 13, in the third embodiment of the connector 50, the connecting protrusion portions 52 are arranged in plate shapes, the lower ends of the side edges of the connecting protrusion portions 52 are bent inwardly and extend to form side reinforcing portions 522 connected to the connecting bottom plate 51, and the side reinforcing portions 522 can be arranged either on one side of the connecting protrusion portions 52 or on two sides of the connecting protrusion portions 52. Thus, it can enhance the structural strength of the connector 50.

As shown in FIG. 14, in the fourth embodiment of the connector 50, the connecting protrusion portions 52 are arranged in plate shapes, the lower ends of the inner sides of the connecting protrusion portions 52 are provided with reinforcing ribs 523 connected to the connecting bottom plate 51, and/or, a reinforcing convex rib structure is arranged on the connecting bottom plate 51, and/or, reinforcing convex rib structures are arranged on the connecting protrusion portions 52. Thus, it can enhance the structural strength of the connector 50.

As shown in FIG. 15, in the filth embodiment of the connector 50, the connecting bottom plate 51 is hollowed out. Thus, it can ensure the structural strength during transmission and reduce the energy loss by reducing the weight.

In the sixth embodiment of the connector 50, the connecting protrusion portions 52 are arranged in plate shapes and are hollowed out. Thus, it can ensure the structural strength during transmission and reduce the energy loss by reducing the weight. Meanwhile, as the connecting protrusion portions 52 are hollowed out, air on two sides of the connecting protrusion portions 52 can circulate so as to increase the effective circulating area indirectly.

As shown in FIG. 16, in the seventh embodiment of the connector 50, the connecting bottom plate 51 is arranged in a round shape. Surely, the connecting bottom plate 51 can be also arranged in square, runway or elliptical shapes and the like.

It can be understood that the second to the seventh embodiments of the connector 50 can be combined with each other without contradiction.

Figure 3:
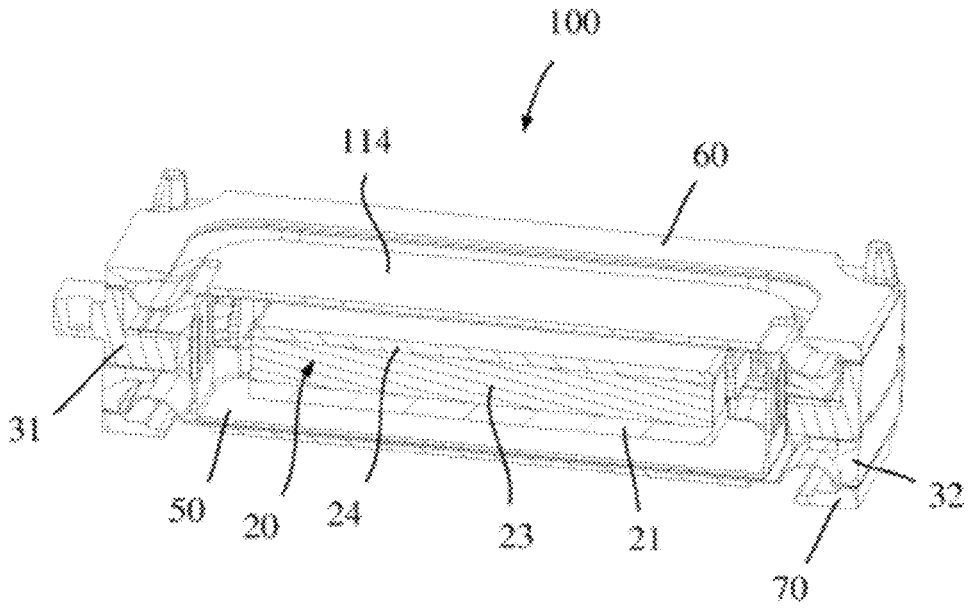
FIG. 3 is a schematic view of a cross-sectional structure of the sound production device in FIG. 1 from a perspective.
Figure 4:
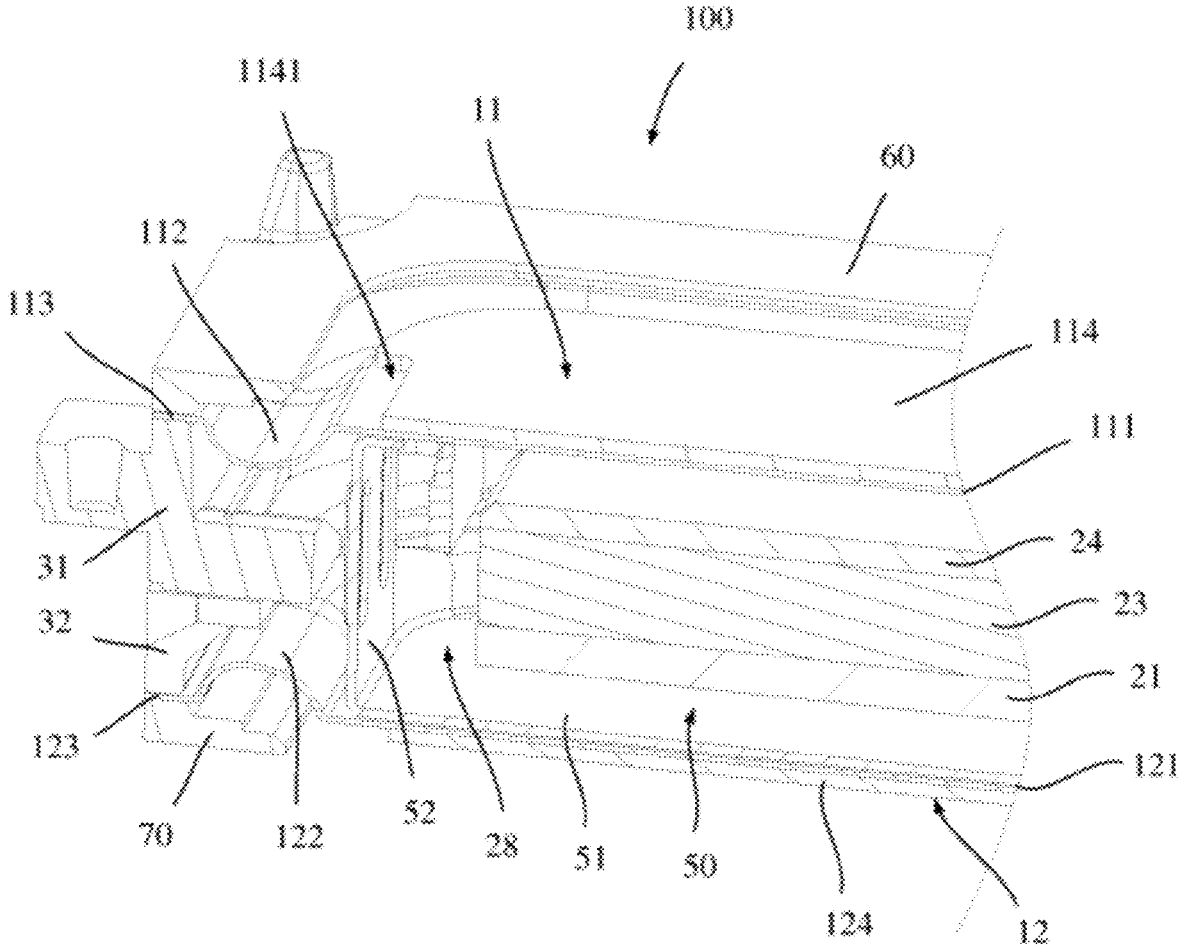
FIG. 4 is a schematic view of a partial structure in FIG. 3.
Figure 5:
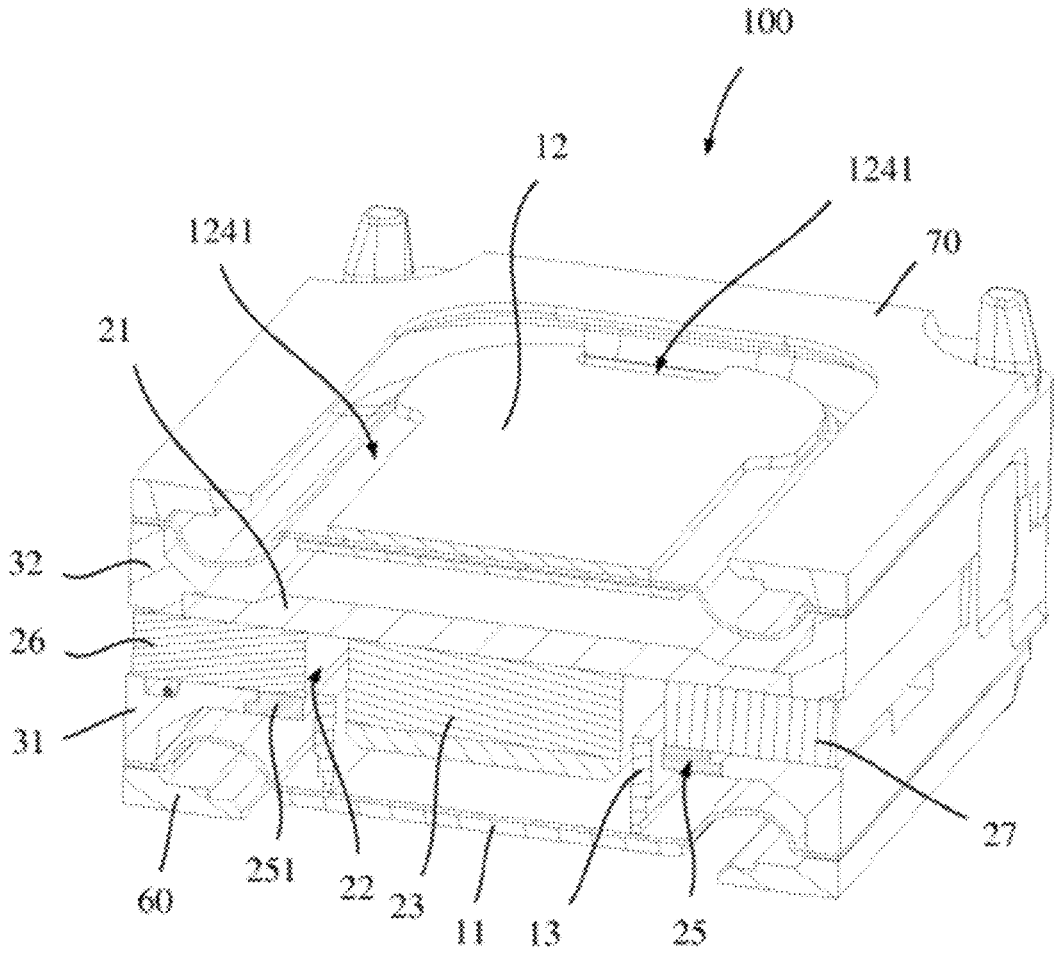
FIG. 5 is a schematic view of a cross-sectional structure of the sound production device in FIG. 1 from another perspective.
Figure 6:
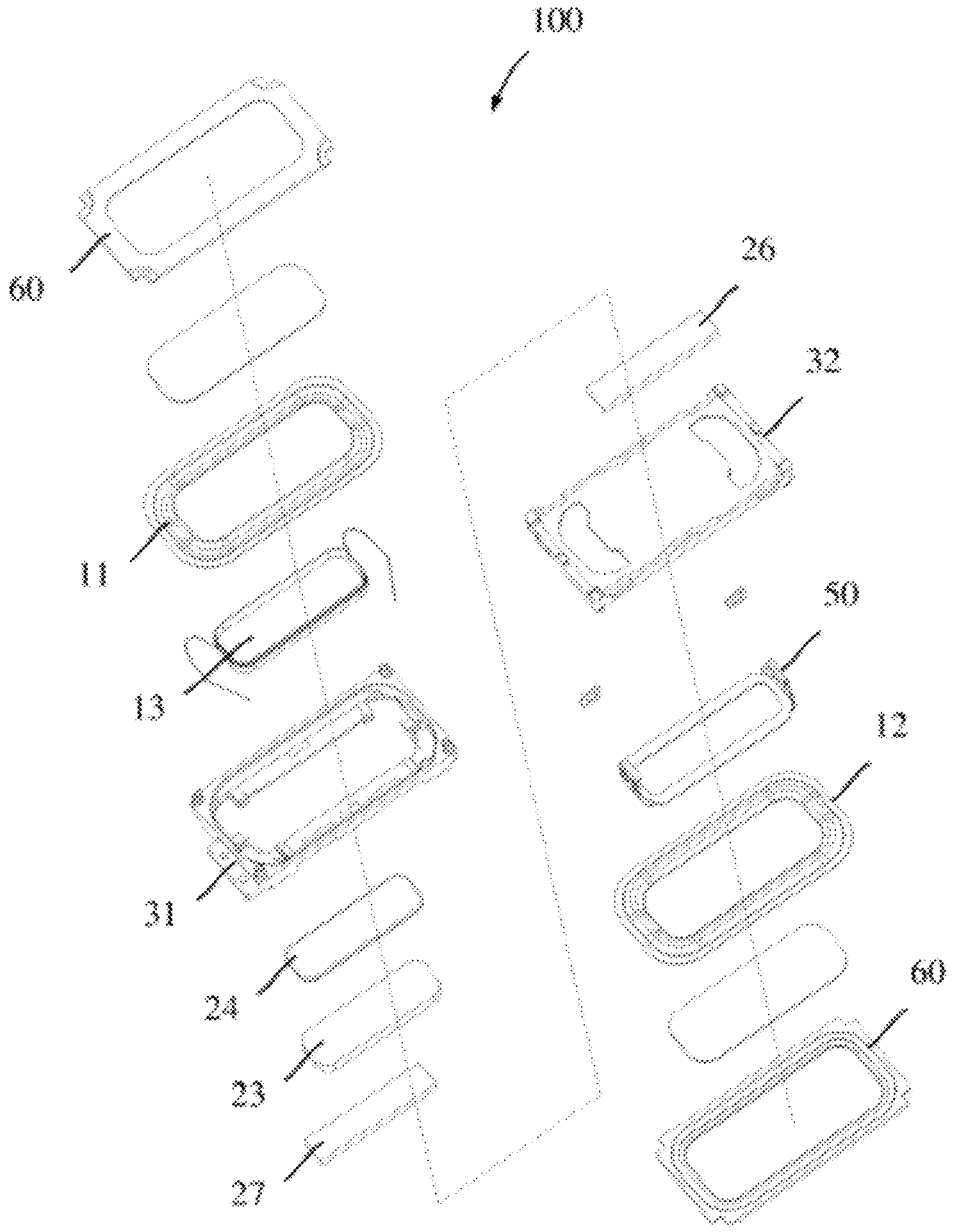
FIG. 6 is a schematic view of an explosive structure of the sound production device in FIG. 1.

Further, as shown in FIG. 3 to FIG. 5, the first diaphragm 11 comprises a first central portion 111, a first corrugated rim 112 arranged around the first central portion 111 and a first fixation portion 113 arranged around the first corrugated rim 112; the connecting protrusion portions 52 being fixed to a lower side of the first central portion 111; the first central portion 111 being a flat sheet structure; the first corrugated rim 112 being a structure formed by one protrusion or being a wavy structure formed h at least one protrusion and at least one recess.

In the embodiment, the first central portion 111 is used for bearing an action force of the connector 50 and vibrates therewith to produce sound, that is, linkage radiation sounding. By arranging the first central portion 111 as the planar sheet structure, it will occupy a relatively small space in the up-down direction but can generate a great enough amplitude. The first corrugated rim 112 provides a certain smoothness, that is, a certain flexibility, to movement of the central portion, so that the first central portion 111 is more prone to be pushed by the connector 50 or air.

In particular, the sound production device 100 further comprises a front cover 60, and the first fixation portion 113 is clamped between the front cover 60 and the first shell 31.

Based on a substantially same principle as the first diaphragm 11, the second diaphragm 1 comprises a second central portion 121, a second corrugated rim 122 arranged around the second central portion 121 and a second fixation portion 123 arranged around the second corrugated rim 121; the connecting bottom plate 51 being fixed to an upper side of the second central portion 121; the second central portion 121 being a flat sheet structure; the second corrugated rim 122 being a structure formed by one protrusion or being a wavy structure formed by at least one protrusion and at least one recess.

In particular, the sound production device 100 further comprises a back cover 70, and the second fixation portion 123 is clamped between the back cover 70 and the second shell 32.

In particular, the first central portion 111 and the second central portion 121 are arranged in sheet structures, which may cause that the sound production device 100 of the present invention form a thinner structure in the up-down direction integrally, and therefore is more prone to be applied to a fiat mounting space.

Further, as shown in FIG. 3 to FIG. 5, the first diaphragm 11 further comprises the first reinforcement portion 114 combined to the first central portion 111. The first reinforcement portion 114 is arranged to mainly increase the rigidity of the first diaphragm 11, reduce the partition vibration and improve the high frequency performance.

Further, as shown in FIG. 3 to FIG. 5, the upper end of the connecting protrusion portion 52 is bonded to the first diaphragm 11, and a first notch 1141 is formed in a bonded part of the connecting protrusion portion 52 and the first central portion 111 corresponding to a periphery of the first reinforcement portion 114. Thus, it may facilitate the enhancement of the bonding effect of the connecting protrusion portion 52 and the first central portion 111.

Based on a substantially same principle as the first diaphragm 11, the second diaphragm 12 further comprises a second reinforcement portion 124 combined to the second central portion 121, and a second notch 1241 is formed in a bonded part of a periphery of the connecting bottom plate 51 and the second central portion 121 corresponding to the second reinforcement portion 124. Thus, it may facilitate the enhancement of the bonding effect of the connecting bottom plate 51 and the second central portion 121.

It should be noted that the above is introduced by taking bidirectional sound production achieved by connecting the first and second diaphragms with an independent connector as an example. However, the technical solution not only can be applied to this situation, but also can be applied to structures in other modes to achieve the bidirectional sound production, for example, the connector can be a structure formed by bending and extending the second reinforcement portion combined to the second diaphragm toward a direction close to the second diaphragm/voice coil integrally, that is, the structure can be achieved as well by bending and extending the second reinforcement portion to the bottom end of the voice coil or the first diaphragm rather than introducing the connector independently.

Or, the voice coil can be wound onto a voice coil framework. The voice coil framework is bent and extended integrally toward a direction close, to the second diaphragm second reinforcement portion, thereby connecting and fixing the first and second diaphragms. In other words, application of the technical solution is not limited to the above examples. The scope of application of the technical solution is not limited regardless of a round sound production device and a rectangular sound production device, a single magnetic circuit structure and the multi-magnetic circuit structure, unidirectional sound production and bidirectional sound production and forms of the connector as long as the conventional housing in the sound production device is split into two shells and the magnetic yoke in the magnetic circuit system and the second shell are injection molded integrally.

Surely, in some other embodiments of the present invention, the gas ports are also disposed in the middle position of the magnetic circuit system 20. In particular, the gas port comprises a central gas port (not shown in Figure) which penetrates through the magnetic yoke 21 and the central position of the magnetic circuit system 20. In the embodiment, the central gas port penetrates through the central concentrating flux plate 24, the central magnet 23 and the magnetic yoke 21 successively to communicate the first sound cavity to the second cavity. One connector 50 is arranged in the central gas port, the upper end of the connector 50 is connected to the first diaphragm 11 and the lower end of the connector 50 is connected to the second diaphragm 12, wherein the connector 50 is preferably in a hollow barrel shape. Detailed description is not repeated herein.

Surely, in some other embodiments of the present invention, it may also be in a way of combining the central gas port with the side gas port 28, and detailed description is not repeated herein.

It is particularly emphasized that the present invention has at least the following technical effects:

1) by injection molding the magnetic yoke 21 and the second shell 32 as an integrate((part and injection molding and fixing the side concentrating flux plate 25 to the first. shell 31, the problem that it is inconvenient to assemble the magnetic yoke 21, the side concentrating flux plate 25 and the housing 30 can be solved, so that the assembling efficiency of the sound production device 100 can be improved;

2) by achieving bidirectional sound production by means of one voice coil 13, the sound production device is simple in structure and easy to implement;

3) the bonding pad of the product extends outside the housing 30, so that on the one band, the first diaphragm 11 and the second diaphragm 12 can keep consistent effective radiating areas and thus consistent acoustic performance; and on the other hand, the first diaphragm 11 and the second diaphragm 12 may have the largest effective radiating areas and obtain the optimum acoustic performance;

4) with the design of splitting the housing 200 and arranging the electric connection point of the voice coil 13 and the external circuit outside the housing 30, it can provide a larger space for the magnetic circuit system 20 and further improve the acoustic performance of the product.

The present invention further provides a portable terminal. As shown in FIG. 1 to FIG. 19, the portable terminal 1000 comprises a housing 200 provided with an accommodation cavity 201 therein. The portable terminal 1000 further comprises the sound production device 100. The specific structure of the sound production device 100 refers to the embodiments. As the portable terminal 1000 adopts all technical solutions of all the embodiments, the portable terminal 1000 has all beneficial effects brought by the technical solutions of the embodiments, and detailed description is not repeated herein.

As shown in FIG. 16 to FIG. 19, the sound production device 100 is mounted in the accommodation cavity 201 and the housing 200 is provided with a first sound hole 202 corresponding to the first diaphragm 11 and a second sound hole 2.03 corresponding to the second diaphragm 12.

Preferably, in order to shorten the propagation path of sound in the housing 200 to reduce acoustic resistance, the first sound hole 202 is disposed in a position, aligned with the first diaphragm 11, of the housing 200 and the second sound hole 203 is disposed in a position, aligned with the second diaphragm 12, of the housing 200.

Further, the housing 110 of the portable terminal 100 has a front surface and a back surface arranged oppositely, wherein the first sound hole 130 is disposed in the front surface and the second sound hole 140 is disposed in the back surface, thereby achieving bidirectional synchronous sound production.

The above is only the preferred embodiments of the present invention and is not intended to limit the patent scope of the present invention. Under the inventive concept, any equivalent structure or modification used according to the contents of the specification and drawings in the present invention matter whether it is directly or indirectly used in any other related technical field should be included within the protection scope of the present invention.

The invention claimed is:

1. A sound production device, comprising a vibration system and a magnetic circuit system, the vibration system and the magnetic circuit system being mounted and fixed to a housing, wherein the housing comprises a first shell and a second shell connected and fixed together;

the vibration system comprises a first diaphragm, mounted on a first surface of the first shell distal from the second shell; and the magnetic circuit system comprises a magnetic yoke, wherein the magnetic yoke and the second shell are injection molded as an integrated part, and wherein the magnetic circuit system further comprises a central magnetic circuit portion and a side magnetic circuit portion, and the central magnetic circuit portion and the side magnetic circuit portion form a magnetic gap therebetween;

the central magnetic circuit portion comprises a central magnet arranged on the magnetic yoke and a central concentrating flux plate arranged on the central magnet, the side magnetic portion comprises a side concentrating flux plate arranged separated from the central concentrating flux plate, and the side concentrating flux plate is fixed to the first shell by injection molding.

2. The sound production device according to claim 1, wherein the side magnetic circuit portion further comprises a first side magnet arranged on a first side of the central magnet and a second side magnet arranged on a second side of the central magnet, and the side concentrating flux plate comprises a first side concentrating flux plate arranged on the first side magnet and a second side concentrating flux plate arranged on the second side magnet.

3. The sound production device according to claim 2, wherein the magnetic yoke is in a flat plate shape and is arranged to form a bottom wall of the second shell.

4. The sound production device according to claim 3, wherein a portion of the first shell facing the second shell is provided with a recess/protrusion structure, and a portion of the second shell facing the first shell is provided with a matching protrusion/recess structure; and wherein the first shell and the second shell are positioned through the matching protrusion and recess structures, and the first shell and the second shell are bonded and fixed together by glue.

5. The sound production device according to claim 1, wherein the first shell is provided with a first electric connector and a second electric connector for electrically connecting a voice coil of the vibration system to an external circuit, and the first electric connector is connected to a first lead of the voice coil of the vibration system, and the second electric connector is connected to a second lead of the voice coil of the vibration system.

6. The sound production device according to claim 5, wherein the first shell is configured in a rectangular shape, and the first electric connector and the second electric connector are configured at an end of a short edge of the first shell.

7. The sound production device according to claim 6, wherein the end of the short edge of the first shell protrudes outwardly with a mounting protrusion portion;

the first electric connector is provided with a first bonding pad and a second bonding pad that are exposed on the mounting protrusion portion and located on an inner side of the first shell; and the second electric connector is provided with a third bonding pad and a fourth bonding pad that are exposed on the mounting protrusion portion and located on the inner side of the first shell; and the first bonding pad and the third bonding pad are electrically connected to an external circuit.

8. The sound production device according to claim 7, wherein the first shell is further provided with a third electric connector and an electric adapter having first and second ends, the third electric connector arranged on one end of the first shell distal from the mounting protrusion portion, and wherein the first end of the electric adapter is connected to the third electric connector and the second end of the electric adapter is connected to the second electric connector; and wherein one of the first lead and the second lead of the voice coil is electrically connected to the second electric connector by passing through the third electric connector and the electric adapter sequentially while a different one of the first lead and the second lead of the voice coil is electrically connected to the first electric connector.

9. The sound production device according to claim 8, wherein the third electric connector is provided with a fifth bonding pad exposed. on an upper side surface of the first shell and a sixth bonding pad exposed on a lower side surface of the first shell, the second bonding pad being exposed on the upper side surface of the first shell, the fourth bonding pad being exposed on the lower side surface of the first shell, and the sixth bonding pad and the fourth bonding pad being arranged close to the same long edge of the first shell;

two ends of the electric adapter are connected to the sixth bonding pad and the fourth bonding pad respectively;

two leads of the voice coil are connected to the fifth bonding pad and the second bonding pad respectively.

10. The sound production device according to claim 9, wherein the lower side surface of the first shell is provided with a lead slot extending from the sixth bonding pad to the fourth bonding pad, the electric adapter being buried in the lead slot.

11. The sound production device according to claim 1, wherein the vibration system further comprises a second diaphragm arranged opposite to the first diaphragm, the second diaphragm mounted on a surface of the second shell distal from the first shell, and the voice coil of the vibration system arranged on a lower side of the first diaphragm;

the magnetic circuit system is arranged between the first diaphragm and the second diaphragm, the magnetic circuit system and the first diaphragm form a first sound cavity therebetween, and the voice coil partially extending into the magnetic gap of the magnetic circuit system, and the magnetic circuit system and the second diaphragm form a second sound cavity therebetween, and the first sound cavity and the second sound cavity are provided with a gas port therebetween.

12. The sound production device according to claim 11, wherein the sound production device further comprises a connector, the connector being at least partially arranged in the gas port, being fixedly connected to the first diaphragm with an upper end of the connector and being fixedly connected to the second diaphragm with a lower end of the connector.

13. The sound production device according to claim 12, wherein the gas port comprises a plurality of side gas ports disposed in the second shell, being in communication with the magnetic gap of the magnetic circuit system to the second sound cavity, and being spaced apart along a circumferential direction of the magnetic gap;

the connector comprises a connecting bottom plate and a plurality of connecting protrusion portions protruding from the connecting bottom plate, the connecting bottom plate being arranged between the second shell and the second diaphragm and being fixedly connected to the second diaphragm, and the plurality of connecting protrusion portions passing through the side gas ports in a one-to-one correspondence manner to be fixedly connected to the first diaphragm.

14. The sound production device according to claim 13, wherein the connecting protrusion portions are arranged in plate shapes, and wherein the connecting protrusions and/or connecting bottom plate are selected from the group consisting of:

the connecting protrusion portions are formed with connecting flanges that are bent inward, or outward, or partially inward and partially outward at upper ends thereof; and the connecting protrusion portions are arranged in plate shapes, and lower ends of side edges of the connecting protrusion portions are bent inward to form side reinforcement portions connected to the connecting bottom plate; and the lower ends of the inner sides of the connecting protrusion portions are provided with reinforcing ribs connected to the connecting bottom plate; and/or the connecting bottom plate is hollowed out; and the connecting protrusion portions are arranged in plate shapes and are hollowed out; and the connecting bottom plate is arranged in a square, round, racetrack or elliptic shape.

15. The sound production device according to claim 11, wherein the gas port comprises a central gas port penetrating middle positions of the magnetic yoke and the magnetic circuit system.

16. A portable terminal, comprising a housing provided with an accommodation cavity internally, wherein the portable terminal further comprises the sound production device according to claim 11, the sound production device being mounted in the accommodation cavity, and the housing being provided with a first sound hole corresponding to the first diaphragm and a second sound hole corresponding to the second diaphragm.

17. The sound production device according to claim 12, wherein the connector is a structure formed by bending and extending a second reinforcement portion combined to the second diaphragm integrally toward a direction close to the second diaphragm/voice coil;

or, the voice coil is wound on a voice coil framework, the connector being a structure formed by bending and extending the voice coil framework integrally toward a direction close to the second diaphragm/second reinforcement portion.

18. The sound production device according to claim 13, wherein the first diaphragm comprises a first central portion, a first corrugated rim arranged around the first central portion and a first fixation portion arranged around the first corrugated rim, the connecting protrusion portions being fixed to a lower side of the first central portion, the first corrugated rim being a structure formed by one protrusion or being a wavy structure formed by at least one protrusion and at least one recess; and/or the second diaphragm comprises a second central portion, a second corrugated rim arranged around the second central portion and a second fixation portion arranged around the second corrugated rim, the connecting bottom plate being fixed to an upper side of the second central portion, the second corrugated rim being a structure formed by one protrusion or being a wavy structure formed by at least one protrusion and at least one recess.

19. The sound production device according to claim 18, wherein the first diaphragm further comprises a first reinforcement portion combined to the first central portion, the first reinforcement portion provided with a first notch at periphery thereof corresponding to a bonded part of the connecting protrusion portion and the first central portion; and/or the second diaphragm further comprises a second reinforcement portion combined to the second central portion, the second reinforcement portion being provided with a second notch at periphery thereof corresponding to a bonded part of a periphery of the connecting bottom plate and the second central portion.

20. A portable terminal, comprising a housing provided with an accommodation cavity internally, wherein the portable terminal further comprises the sound production device according to claim 1, the sound production device being mounted in the accommodation cavity, and the housing being provided with a first sound hole corresponding to the first diaphragm.

* * * * *